US006299022B1

(12) United States Patent
Bublewitz et al.

(10) Patent No.: US 6,299,022 B1
(45) Date of Patent: Oct. 9, 2001

(54) FILM PACKING FOR A PASTY SUBSTANCE

(75) Inventors: Alexander Bublewitz, Herborn; Matthias Suchan, Hachenburg, both of (DE)

(73) Assignee: Kettenbach GmbH & Co. KG (DE)

( * ) Notice: Subject to any disclaimer, the term of this patent is extended or adjusted under 35 U.S.C. 154(b) by 0 days.

(21) Appl. No.: 09/609,117

(22) Filed: Jun. 30, 2000

(30) Foreign Application Priority Data

| | | |
|---|---|---|
| Jul. 2, 1999 | (EP) | 99112692 |
| Oct. 5, 1999 | (DE) | 199 47 793 |
| Dec. 20, 1999 | (DE) | 199 61 446 |

(51) Int. Cl.[7] ..... B67D 5/00

(52) U.S. Cl. ..... 222/83.5; 222/326; 222/386; 222/95; 222/105

(58) Field of Search ..... 222/82, 83, 83.5, 222/88, 95, 105, 326, 386, 541.2, 541.6

(56) References Cited

FOREIGN PATENT DOCUMENTS

| | | |
|---|---|---|
| 296 13 945 U1 | 11/1997 | (DE) . |
| 296 17 654 U1 | 2/1998 | (DE) . |
| 0 653 362 A1 | 9/1994 | (EP) . |
| 0 863 088 A1 | 6/1998 | (EP) . |

*Primary Examiner*—Kevin Shaver
*Assistant Examiner*—Patrick Buechner
(74) *Attorney, Agent, or Firm*—Diller, Ramik & Wight

(57) ABSTRACT

A film packing for a pasty substance comprises a film tube bag (12) having a peripheral wall (14) and two ends (16), and a cover portion (22) fastened to one of the two ends (16) of the film tube bag (12). The cover portion (22) comprises an end face (24) having a passage opening (32) for the passage of pasty substance from the opened film tube bag (12), a peripheral face (26) joining the end face (24), and a sealing element (52) abutting to a receiving headpiece (36) attachable to the end (16) of the film tube bag (12) carrying the cover portion (22). The receiving headpiece (36) surrounds at least the end face (24) and the peripheral face (26) of the cover portion (22) and comprises an outlet piece (44) which is in fluid connection with the passage opening (32) of the cover portion (22) when the receiving headpiece is attached (36). In a first position in which the piercing pin (48) is arranged at a distance from the film tube bag (12), the cover portion (22) is locked to the receiving headpiece (36) for securing against unintended movement of the film tube bag (12) farther into the receiving headpiece. Upon deactivation of the locking device, the cover portion (22) can be moved from this position into a second position in which the piercing pin (48) penetrates the film tube bag (12).

19 Claims, 12 Drawing Sheets

46
44
36
32
24
18
40
22
26
54
II
48
42
64
52
50
53
30
28
56
58
16
60
20
34
14
10
12

46
44
36
48
32
70
18
40
22
52
42
56
60
68
60
66
58
38
34

36
48
42
22
82
60
80
12

46
44
40
36
48
18
84
104
XVI
XVI
22
42
20
14

FIG.16
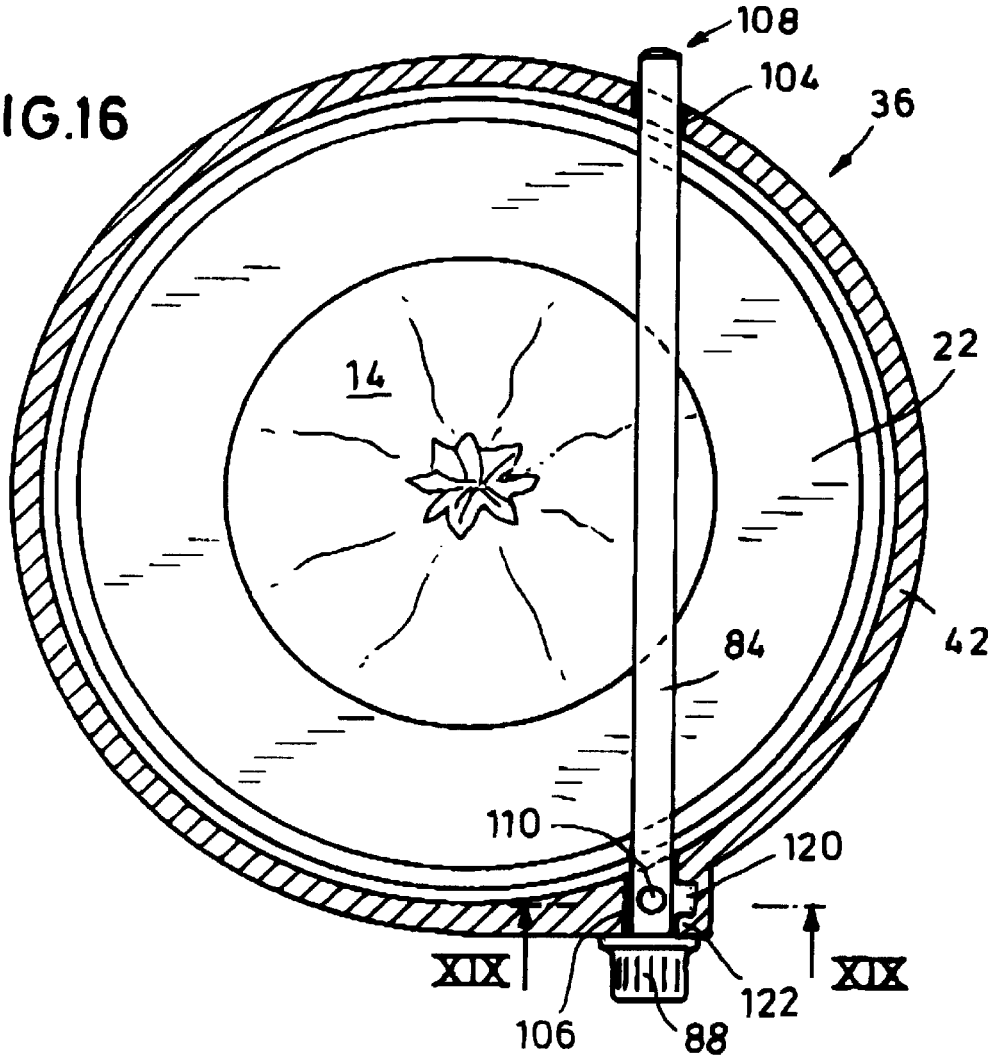
FIG.17
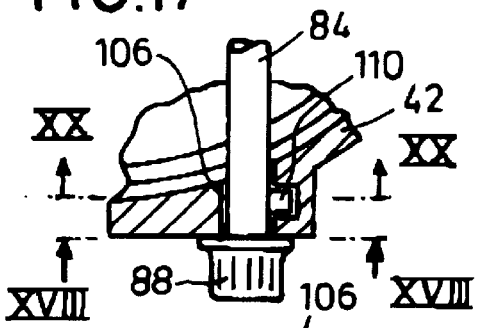
FIG.18
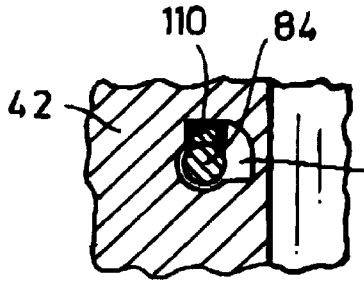
FIG.19
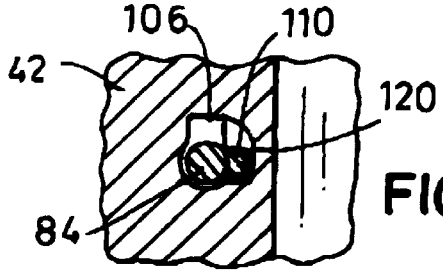
FIG.20

FILM PACKING FOR A PASTY SUBSTANCE

BACKGROUND OF THE INVENTION

The invention relates to a film packing for a pasty substance, in particular an adhesive, sealing and/or forming masses or other age-hardening substances.

Pasty substances are normally marketed in disposable packings which are inserted into application devices such that they can be applied. In some cases the disposable packings are configured as rigid cartridges having a movable bottom which is moved, like a piston, into the cylindrical housing of the cartridge to discharge the pasty substance. Due to the relatively large amount of packing material to be disposed of, flexible disposable packings in the form of film tube bags are frequently used. Said film tube packings are made of a metal or plastic film tube which is tied together by clips at its two ends. Such a film tube bag is inserted into the cylindrical chamber of an applicator which comprises an outlet piece at one end of the cylindrical chamber. A stamp-type plate of the applicator is moved into the other end of the cylindrical chamber, which plate exerts a pressure onto the film tube bag and the pasty substance contained therein so that said substance is discharged through a passage opening in the end of the film tube bag facing the outlet piece and leaves the applicator through said outlet piece. Film packings of the type described above are e.g. known from DE-U-296 17 654, DE-U-296 13 945, EP-A-0 863 088 and EP-A-0 653 362.

The known film tube packings have substantially proved successful in practical applications. However, the process of opening the film tube packings is still in need of improvement. A known procedure is to use piercing pins or spikes for this purpose, which pierce the film tube when the latter is inserted. The film tube and the receiving headpiece with the piercing pin and the outlet piece receiving the former must be assembled for the purpose of opening the film tube, which impedes the handling and is considered a nuisance.

It is an object of the invention to provide a film tube packing which is easier to open by means of a piercing pin.

SUMMARY OF THE INVENTION

This object is solved according to the invention by means of a film packing for a pasty substance comprises a film tube bag having a peripheral wall and two ends, and a cover portion fastened to one of the two ends of the film tube bag. The cover portion comprises an end face having a passage opening for the passage of pasty substance from the opened film tube bag, a peripheral face joining the end face, and a sealing element abutting to a receiving headpiece attachable to the end of the film tube bag carrying the cover portion. The receiving headpiece surrounds at least the end face and the peripheral face of the cover portion and comprises an outlet piece which is in fluid connection with the passage opening of the cover portion when the receiving headpiece is attached. In a first position in which the piercing pin is arranged at a distance from the film tube bag, the cover portion is locked to the receiving headpiece for securing against unintended movement of the film tube bag farther into the receiving headpiece. Upon deactivation of the locking device, the cover portion (22) can be moved from this position into a second position in which the piercing pin penetrates the film tube bag.

The locking device according to the invention allows the film tube bag to be locked via its cover element to the receiving headpiece in a preliminary position in which the piercing pin arranged on the receiving headpiece has not yet pierced the film tube bag. Only by moving the film tube bag, which is in particular snappingly held by the receiving headpiece, further into the receiving headpiece is in the film tube packing pierced. In this position, too, the cover element of the film tube bag is preferably locked to the receiving headpiece. The locking device arranged between receiving headpiece and film tube bag offers, in the preliminary position, the advantage that the two parts can be delivered together and that the user opens the film tube bag by a defined movement of the two parts. This is appropriate in particular when both the receiving headpiece and the film tube bag are configured as disposable articles.

The locking device between receiving headpiece and cover portion is preferably realized by elements optionally being adapted to be disengaged and appropriately configured as snapping device. Said snapping device comprises in particular complementary snapping projections and snap-in recesses arranged on the cover portion and the receiving headpiece. Said snapping projections and snap-in recesses are attached to e.g. elastic studs in particular of the cover portion. Generally such an elastic stud is sufficient; for reasons of ease of handling it is, however, appropriate to provide two studs arranged diametrically opposite each other on the cover portion. Said studs extend transversely to the end face of the cover portion and are accessible from outside when the cover portion can be released from the receiving headpiece when a force is applied from outside on the at least one stud.

In an alternative embodiment of the invention the locking device is configured as a connection having a weakening line. The connection between cover portion and receiving headpiece in the first position (preliminary position) can thus be released e.g. by a breakable release portion (e.g. breaking ring) so that the cover portion can then be shifted in the direction of the second position into the receiving head position.

The connection with the weakening line offers the advantage that the holding fixture of the cover portion on the receiving headpiece can be configured in such a stable and durable manner that during transport of the preassembled unit of receiving headpiece and film tube bag including the cover portion the cover portion does not separate from the receiving headpiece and assume the second position. Thus a special transport protective means is not required.

Further the locking device offers the advantage that the cover portion is adapted to be connected with the receiving headpiece to protect the cover portion against unintentional releasing from the receiving headpiece. This specific manner of locking of the cover portion to the receiving headpiece facilitates removal of a film tube bag from the applicator. Without this temporary connection the receiving headpiece would be taken out of the pressure chamber of the applicator with the film tube bag and its cover portion remaining in the cylindrical pressure chamber. To remove the film tube bag from the cylindrical pressure chamber the cover portion would have to be grasped by hand and the film tube thus pulled out of the pressure chamber. It is however easier to take the film tube bag out of the pressure chamber by grasping the receiving headpiece. This is realized according to the invention by the locking device between cover portion and receiving headpiece.

Alternative embodiments of the locking device are a bayonet catch or a thread. Besides a releasable positive locking the locking device may be realized by a releasable non-positive locking configured as frictional connection.

To facilitate movement of the cover portion with the film tube bag from the preliminary position to the final position on the receiving headpiece it is advantageous when the snapping action does not present too large a resistance. However this is disadvantageous to a certain degree during the transport of the film tube bag preliminarily positioned on the receiving headpiece. During the transport care should be taken that the film tube bag does not accidentally move from the preliminary position in the direction of the final position and further into the receiving headpiece since this would result in an unintentional opening of the film tube bag and thus discharge of the material contained therein.

To solve the aforementioned problem it is proposed, according to an alternative embodiment of the present invention, to employ a film tube packing where, according to the invention, a stopping element is arranged on the receiving headpiece, the stopping element being movable between a stopping position, to prevent unintentional movement of the film tube bag from the preliminary position in the direction of the final position, and a release position in which the film tube bag can be moved into the final position. Said stopping element may have various configurations and e.g. lock the cover portion to the receiving headpiece such that the cover portion cannot be moved from the preliminary position either in the direction of the final position or in the opposite direction. However with regard to the considerations and solutions forming the basis of the present invention it is sufficient when the stopping element merely ensures that the film tube bag is not movable towards the final position. Thus it e.g. suffices when the stopping element in its stopping position extends into the space between the cover portion of the film tube packing and the receiving headpiece.

The stopping element, too, could unintentionally move from its stopping position into its release position. This is appropriately prevented by locking or blocking the stopping element to protect it against unintentional movement into the release position. For this purpose e.g. a frictional or positive connection of the stopping element with the receiving headpiece or the cover portion is sufficient.

As described above, the receiving headpiece comprises an outlet piece. It would be the obvious approach to shift the stopping element from the end averted from the film tube bag into the outlet piece wherein the stopping element extends over the other end of the outlet piece and acts as a stop to delimit the movement of the cover portion and the film tube bag towards the outlet piece. In this embodiment of the present invention the stopping element is twistable between a first and a second twisting position in the outlet piece. In the first twisting position the stopping element is in its stop position. In the first twisting position it is advantageous when the stopping element is protected against unintentional axial movement out of the outlet piece by being locked in the outlet piece or to the cap and/or the cover portion. This can e.g. be realized by cooperating locking or stopping faces on the stopping element on the one hand and on the outlet piece, the receiving headpiece and/or the cover portion on the other hand. By twisting the stopping element from the first twisting position into the second twisting position the stopping element is unlocked from the receiving headpiece; now the stopping element can be pulled out of the outlet piece and moved into its release position in which the cover portion and the film tube bag fastened thereto can be moved towards the outlet piece and thus towards the piercing pin.

In the version of the present invention described above the stopping element appropriately has the form of a pin or a bolt. At that end of the stopping element which extends from the end averted from the film tube bag when the stopping element is in the outlet piece, the stopping element is configured such that it allows said end of the stopping element to be manually grasped and twisted.

The above development of the film tube packing according to the present invention comprising a stopping element as transport protection means of the preliminarily positioned film tube bag is realizable for receiving headpieces whose outlet pieces exceed a certain minimum diameter. If however the diameter of the outlet piece is too small, the stopping element must be relatively thin. This leads to stability problems and problems with regard to locking the stopping element on the receiving headpiece.

Thus it is advantageous when the stopping element, in its stopping position, extends transversally through the space between the cover portion and the end wall of the receiving headpiece. This can e.g. be effected by the stopping element, in its stopping position, extending through an opening in the peripheral edge on the end wall of the receiving headpiece. With regard to the positional stability of the stopping element it is appropriate when the stopping element extends through two openings arranged opposite each other on the edge. Said two openings are preferably located on a mathematical straight line extending as a secant to the receiving headpiece when the latter is substantially configured as a cylindrical cap. The stopping element, which displays in particular a pin or bolt form, is appropriately adapted to be locked on the receiving headpiece to protect it against unintentional slipping out of the opening/openings of the receiving headpiece. Locking is preferably realized by means of a locking projection which, in a first twisting position of the stopping element, is inserted into a snap-in recess on the receiving headpiece and, in a second twisting position, is disengaged from this snap-in recess with the stopping element being adapted to be axially moved out of said space in this twisting position.

Thus the stopping element forms a transport protection means for the film tube packing when the film tube bag plus the cover portion are preliminarily positioned on the receiving headpiece. This improves handling of the film tube packing according to the invention.

In a preferred development of the present invention it is further provided that the passage opening of the cover part is at least partially surrounded by a sealing projection, or the receiving headpiece comprises a sealing projection which extends through the passage opening and may be of peripheral configuration. In the condition as used said sealing projection rests against the film tube bag. Within the area defined by the sealing projection the film tube bag is open when the pasty substance is discharged from the bag. As mentioned above, the film tube bag can be opened by means of a piercing pin or a similar piercing tool arranged on the receiving headpiece. The lip-type sealing projection seals the area around the opening in the film tube bag, which reduces the risk that the pasty substance leaving the film tube bag smears the inner face of the receiving headpiece.

Arrangement of the piercing tool on the receiving headpiece separated from the film tube bag offers the advantage that the film tube bag is opened only when the receiving headpiece is placed onto the cover portion of the film packing. Thus the opening process takes place after the film packing has been inserted into the pressure chamber of the dispenser or the applicator and only when the user places the receiving headpiece onto the cover portion which rests on one end of the pressure chamber of the dispenser or the applicator.

The above receiving headpiece and its features, in particular a central projection on the inside facing the end of the film tube bag with the snap-in recess for a closing clip arranged at the end of the film tube bag, are to be considered themselves as patentable within the scope of this description.

The known film packings have substantially proved successful in practical applications. Problems may arise concerning sealing of the film tube bag front end facing the outlet piece within the cylindrical chamber of the applicator. Said sealing of the end is realized in DE-U-296 17 654 and DE-U-296 13 945 by means of an O-ring seal arranged at the end in a cover element covering one end of the film tube bag. This type of sealing requires that the cover portion is permanently pressed at sufficient force against the end of the cylindrical chamber carrying the outlet piece. This is not adequately ensured at least in those phases in which the film tube bag is located inside the applicator and no pressure is exerted on the film tube bag.

From EP-A-0 607 609 an applicator is known where the components to be applied are inside a film tube bag. Said components are fed through a headpiece to an outlet nozzle. The headpiece is anchored to a cylindrical container wall by means of a screw cap. Further the headpiece is sealed towards the cylindrical container wall via a sealing ring. Said sealing ring is not attached to the film tube bag. Further said sealing ring is effective only in the screwed-together condition of the applicator and is not effective with regard to the screw cap.

Further, EP-A-0 693 437 describes an applicator for two components each packed in a foil tube wherein a headpiece is arranged on each foil tube, the headpiece comprising a central outlet piece. Both outlet pieces extend into the ends of channels of a counterpart and are sealed towards the channels via an external sealing ring.

In EP-A-0 863 088 and EP-A-0 653 362 it is described that one end of the film tube bag is permanently attached to a cap comprising an outlet piece. Said cap and its outlet piece are arranged at the front end of the cylindrical chamber of the applicator. Thus the cap forms part of the film packing and must be disposed of together with the film packing, which is expensive because of the relatively large amount of material used for the cap.

For this reason the sealing element of the film tube packing according to the present invention is advantageously arranged on the peripheral face and/or in the transition area between end face and peripheral face of the cover portion of said film packing. The film packing according to the present invention thus possesses a radially acting sealing towards the applicator.

The film packing according to the present invention is provided with a film tube bag comprising a peripheral wall and two end faces where the film tube bag is tied together or closed in any other way. One of said two ends carries the cover portion which may be configured as a ring or a disk. Said cover portion comprises an end face and a peripheral face adjoining said end face. Said cover portion and at least a portion of the film tube bag end connected with the cover portion are inserted into a receiving headpiece of an applicator, said receiving headpiece being adapted to be positioned at one of the two ends of a cylindrical pressure chamber of the applicator. Said receiving headpiece is provided with an outlet piece communicating with a passage opening of the cover portion when the receiving headpiece is attached.

To discharge a pasty substance from the film tube bag according to the present invention with the aid of an applicator comprising a stamp-type pressure plate, the film tube bag is opened in an area of its one end being in alignment with the passage opening of the cover portion, so that the pasty substance can leave the open film tube bag through the passage opening and the outlet piece being in fluid connection with the latter.

Sealing between the end of the film tube bag carrying the cover portion and the applicator is effected via a radially arranged sealing element located on the peripheral face of the cover portion and/or in the transition area between end face and peripheral face. In the condition as used of the film tube bag said sealing element rests against the receiving headpiece and/or the cylindrical pressure chamber of the applicator. The sealing element remains in sealing contact with the receiving headpiece and/or the cylindrical pressure chamber irrespective of the pressure exerted by the pressure plate onto the film tube bag. Thus reliable sealing is ensured from the beginning of an application process. In this way the applicator can be effectively prevented from becoming soiled with pasty substance. Only the film tube bag and the cover portion must be disposed of; the receiving headpiece can be reused.

The radially arranged sealing element according to the present invention may have different configurations. Appropriately a sealing ring (in particular an O-ring seal) is used as sealing element, which is arranged in a receiving groove arranged in the peripheral face of the cover portion. Besides a round profile a flat profile may also be used as cross-section of the sealing ring. The sealing element may also be configured as an elastic sealing lip integrally formed with the cover portion. Said sealing lip rests from the inside against the receiving headpiece or the cylindrical pressure chamber of the applicator thus sealing it. A further alternative is to configure the seal as labyrinth seal between the cover portion and the applicator (receiving headpiece and/or cylindrical pressure chamber). Such a labyrinth seal can e.g. be realized by the cover portion comprising on its peripheral face at least one and preferably a plurality of annular projections. In a preferred development of the present invention the cover portion comprises on its peripheral edge a shoulder area within which the cover portion surrounds the transition area between the end and the peripheral wall of the film tube bag. Such a shoulder-type structure of the cover portion allows for improved guiding of the film tube bag and positioning it in the receiving headpiece or the cylindrical pressure chamber of the applicator. When the cover portion is of substantially flat configuration, there is sufficient room for attaching and arranging the sealing element within the surrounding edge of the cover portion.

An alternative to the embodiment of the cover portion described above provides for the cover portion being substantially configured as a disk which does not comprise a projecting surrounding edge and in whose peripheral face defined by the thickness of the disk the sealing element is arranged.

Appropriately the cover portion is configured as an annular portion. This offers advantages with regard to the reduced amount of material required for the cover portion. The annular portion surrounds the film tube bag in the transition area between one end and the peripheral wall. In the remaining area the end of the film tube bag is exposed. Thus the annular portion defines a central passage opening within which the connection with the outlet piece can be effected even if the latter is eccentrically arranged, with the connection between the eccentric outlet piece and the passage opening being of substantially straight configuration, i.e. without considerable deflections which may lead to increased flow resistances. If however a disk-type cover portion is used instead of an annular cover portion and if the receiving headpiece comprises an eccentrically arranged outlet piece, care must be taken during insertion of the film tube bag into the pressure chamber of the applicator that a certain twisting alignment of the film tube bag is adhered to in order to utilize, in the case of eccentric arrangement of the outlet piece, the advantages of a substantially straight flow connection between the passage opening and the outlet piece. However this can be realized at relatively small expenditure by providing the cover portion with engagement projections and recesses cooperating with corresponding engagement recesses/projections of the receiving headpiece thus allowing insertion of the cover portion into the receiving headpiece in only one position (coding).

In a preferred embodiment of the invention it is provided that the cover part comprises within its area flatly resting against the end of the film tube bag a (central) projection acting upon the tied-together section of the film tube bag and pressing said tied-together section into the end of the film tube bag. This allows more material to be taken out of the film tube bag since pressure is not only applied to the bag from the pressure plate side but also through the central projection which moves the tied-together section of the film tube bag in inward direction.

Within the central projection a recess for a closing clip of the film tube bag may be arranged by means of which the film tube bag is tied together and sealed.

Even in the case of an annular configuration of the cover portion additional pressure can be applied by the central projection described above to the end of the film tube bag. In this case the central projection is not located on the cover portion but on the receiving headpiece with said central projection extending through the outlet piece defined by the ring and acting upon the film tube bag. This configuration further presents the advantage that owing to the central impression of the film tube bag the latter arches on the peripheral edge of its end, which facilitates automatic opening of the film tube bag by means of a piercing pin or a similar tool of the receiving headpiece.

BRIEF DESCRIPTION OF THE DRAWINGS

Hereunder embodiments of the present invention are explained in detail with reference to the drawings in which:

FIGS. 15 to 20 show different sectional views of an alternative to the supplement to the exemplary embodiment according to FIGS. 13 and 14 with a stopping element, in different stopping element positions, extending transversally through the space between the cover portion and the receiving headpiece.

DETAILED DESCRIPTION OF PREFERRED EMBODIMENTS

Figure 1:
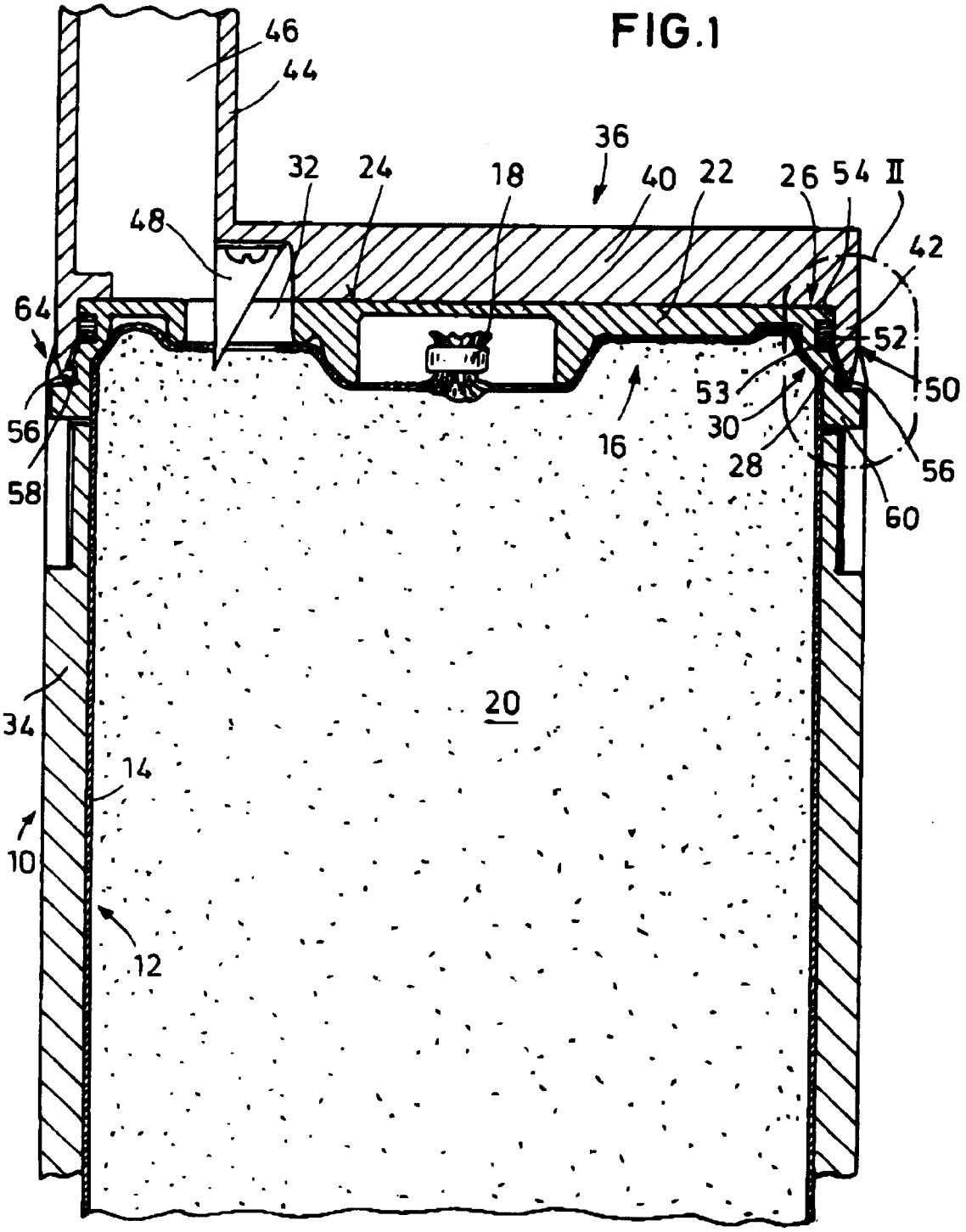
FIG. 1 shows a longitudinal section of the front end of a pressure container with attached receiving headpiece and a film packing located in the receiving headpiece and the pressure container.
Figure 8:
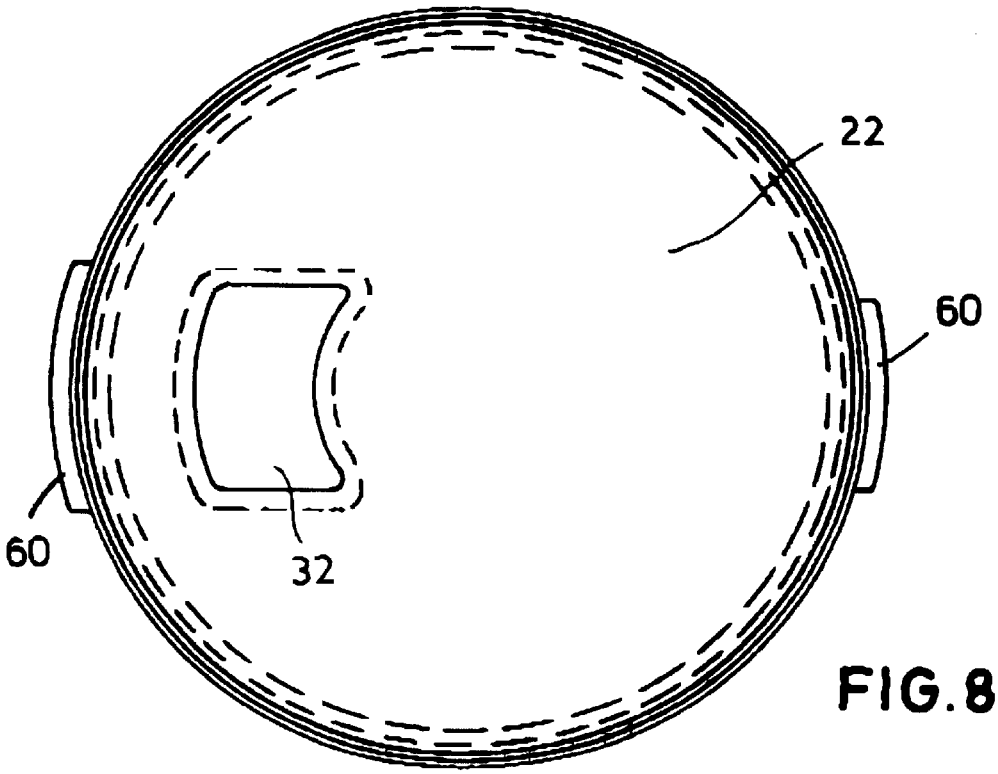
FIG. 8 shows a top view of the cover portion of the film packing according to FIGS. 1 to 7, FIGS. 9 and 10 show representations of an alternative cover portion and the configuration of the film packing in the condition as used in the transition area to the receiving headpiece.

FIG. 1 shows an embodiment of a film packing 10 comprising a film tube bag 12 having an peripheral wall 14 and two end regions 16 (only one of which is shown). On both ends 16, the film tube bag 12 is tied together by means of a closing clip 18 and thus is closed. The sausage-shaped film tube bag 12 contains a pasty substance 20, which can be, e.g., a component of a multi-component shapeable dental mass. Arranged on the end 16 shown in FIG. 1 (hereunder also referred to as the front end) of the film tube bag 12 is a cover portion 22 which is fixedly connected to front end 16. Said cover portion 22 comprises an end face 24 facing away from the film tube bag 12, and has its peripheral edge region 26 formed with an edge 28 protruding from end face 24. Edge 28 surrounds the film tube bag 12 in the manner of a shoulder in the transition region 30 between the front end 16 and the peripheral wall 14 of bag 12. Cover portion 22 extends across the whole end 16 of film packing 10 and has its end face 24 provided with a passage opening 32 (cf. also FIG. 8). When the film tube bag 12 is opened in the region of passage opening 32, the pasty mass will be discharged through this passage opening 32 from the interior of film tube bag 12.

According to FIG. 1, the film packing 10 is arranged in a cylindrical pressure chamber 34 whereof that end which in FIG. 1 is the upper end is provided with a receiving headpiece 36. The other end of pressure chamber 34 (which is not shown in FIG. 1) has a stamp-like pressure plate 38 (cf. FIG. 5) extending thereinto, acting on the film tube bag 12 to axially compress the bag and thus press out the pasty mass 20 from the bag. Pressure chamber 34 forms part of a dispenser or applicator (not shown in greater detail) which is used to discharge and apply the pasty mass. By means of a holding member (likewise not shown), the receiving headpiece 36 is held in position on the front end of pressure chamber 34 shown in FIG. 1; thus, it is prevented that the receiving headpiece 36 becomes detached from pressure chamber 34 when pressure is exerted onto the film tube bag 12 by the pressure plate 38.

As shown in FIG. 1, the receiving headpiece 36 has a cap-shaped structure comprising an end wall 40 and a peripheral edge 42 axially projecting along the periphery of end wall 40. Within end wall 40, there is arranged an outlet piece 44 with a discharge channel 46 which in the mounted condition of the receiving headpiece 36 is in fluid connection with passage opening 32. The receiving headpiece 36 further comprises a piercing pin or spike which is arranged on the inner side of end wall 40 and in the situation according to FIG. 1 extends through passage opening 32 into the film tube bag 12. Thus, at the same moment that the receiving headpiece 36 is mounted to the cover portion 22, the piercing pin 48 penetrates the end 16 of film tube bag 12, thus automatically opening the bag.

During use of the film packing 10, when the pasty substance 20 is applied, it is to be safeguarded that the substance 20 cannot laterally leak out from the dispenser or applicator, particularly in the region of the receiving headpiece 36. According to the invention, a radially arranged seal 50 is provided for this purpose. As shown in FIG. 1, the seal 50 is provided as a separate annular sealing element 52 arranged in the projecting edge 28 of cover portion 22. The annular sealing element 52 is accommodated in a peripheral receiving groove 53 (cf. also FIG. 2) formed in edge 28. Thus, the sealing element 52 is arranged to face radially outwards and to bear from inside against the projecting edge 42 of receiving headpiece 36. The inner side 54 of this projecting edge 42 is inclined so that the receiving headpiece 36 is tapered towards its end wall 40. In this manner, a safe and reliable abutment of the sealing element 52 is obtained on the edge 42 of receiving headpiece 36.

The sealing element 52 is either a flat seal (a shown in FIGS. 1 and 2) or an O-ring. In both cases, the sealing element is provided as a separate component.

Figure 2:
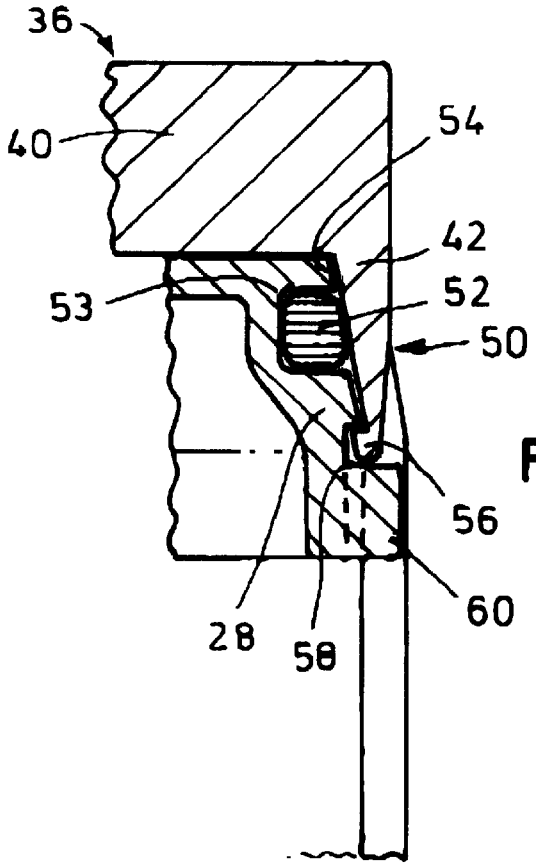
FIGS. 2 to 4 show enlarged views of area II of FIG. 1 to explain the different configurations of the radial seal of the film packing.
Figure 3:
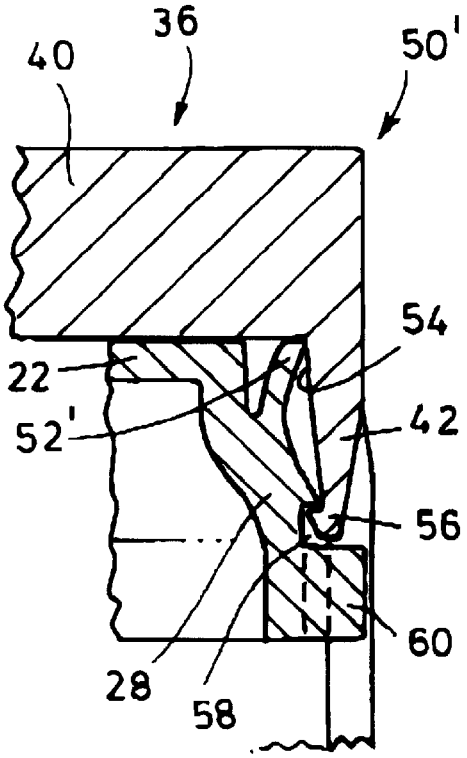
Figure 4:
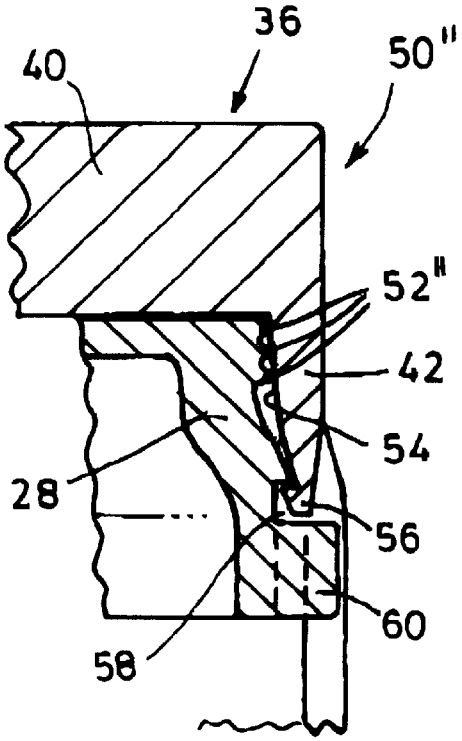

Alternative embodiments of the seal 50 of FIGS. 1 and 2 are illustrated in FIGS. 3 and 4. Sealing 50' of FIG. 3 comprises a seal lip 52' which projects radially outwardly from edge 28 of cover portion 22 and internally abuts the inner side 54 of edge 42 of receiving headpiece 36. The seal 50" of FIG. 4 is formed as a labyrinth seal comprising a plurality of radially projecting and continuous sealing ribs and sealing lips 52", respectively, which likewise are internally arranged in sealing abutment on edge 42 of receiving headpiece 36 when the receiving headpiece 36 has been mounted on the cover portion 22. Thus, the seals 50' and 50" of FIGS. 3 and 4 are embodiments wherein the sealing elements 52' and 52" are formed integrally with cover portion 22.

In all of the above described seals 50,50',50", the sealing elements 52,52',52" project radially from cover portion 22. Thus, the tight connection of the cover portion 22 with the receiving headpiece 36 exists not only when the pressure plate 38 exerts pressure on the film tube bag 12, but is guaranteed also when the film tube bag 12 is in a relaxed condition and the cover portion 22 is in abutment on the end wall 40 of receiving headpiece 36 substantially without pressure. This situation is given whenever the film tube bag 12 is arranged in the dispenser or applicator device but no substance is presently being applied by the device.

Figure 6:
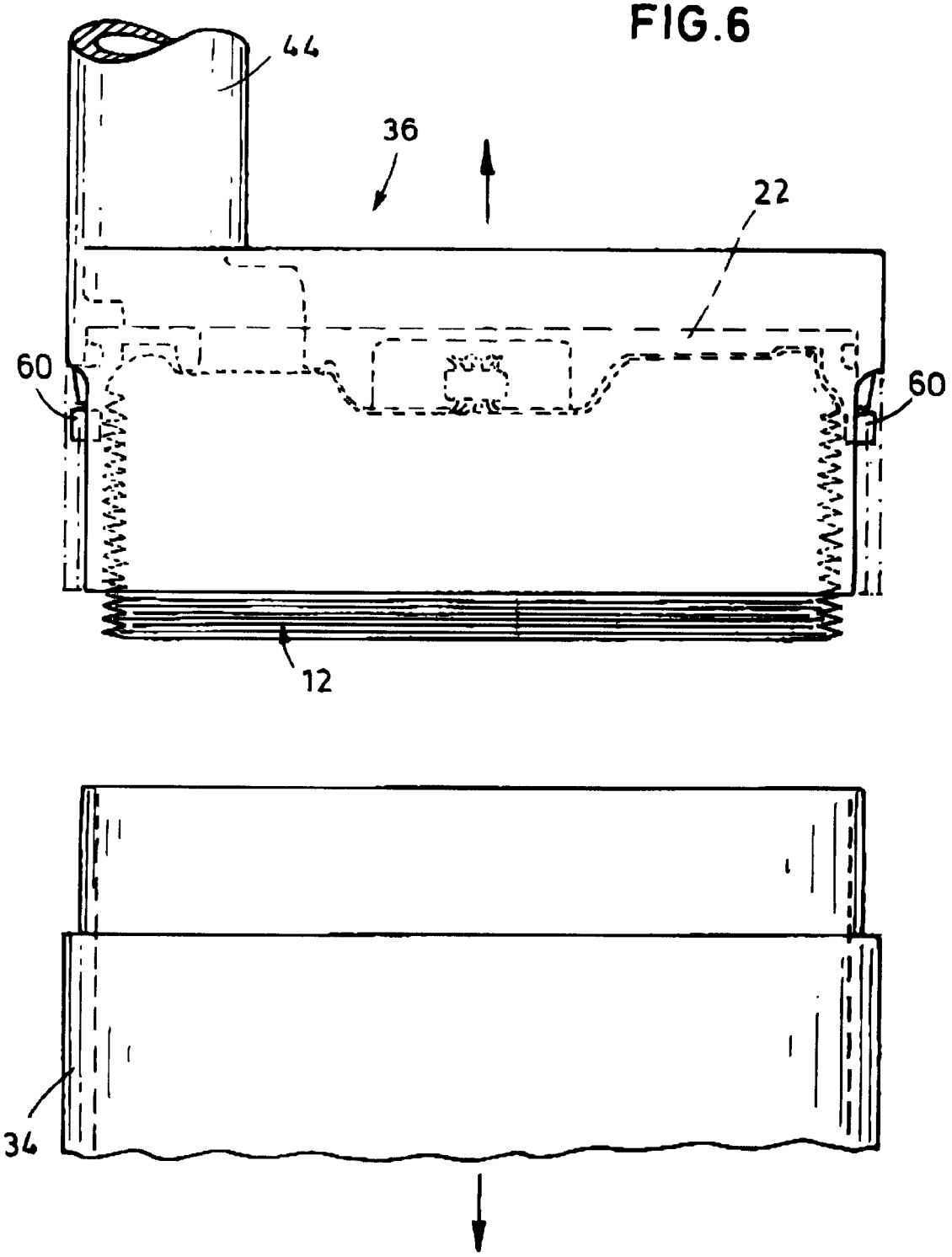
FIG. 6 shows a schematic view of the situation in which the compressed film tube bag is removed from the pressure cylinder by pulling off the receiving headpiece.
Figure 7:
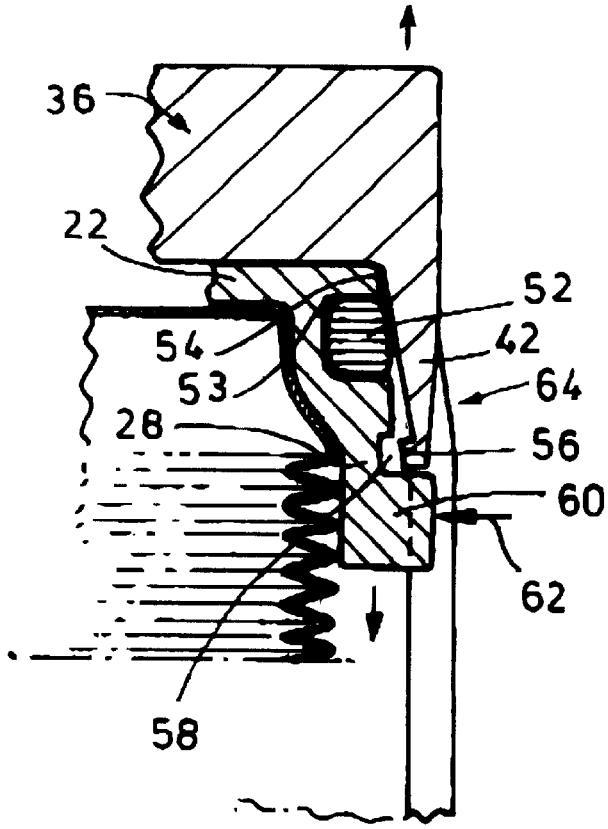
FIG. 7 shows an enlarged representation of the snap-in connection between the film packing and the receiving headpiece and in particular the situation in which the locking device is unlocked.

A further characteristic feature of the film packing 10 will be described hereunder with reference to FIGS. 5 to 7. As evident form these Figures but also from FIGS. 1 to 4, cover portion 22 and receiving headpiece 36 are connected to each other by releasable locking engagement. For this purpose, said edge 42 projecting from end wall 40 of receiving headpiece 36 has its free end provided with a (continuously surrounding) inner locking projection 56 which cooperates with snap-in recesses 58 formed diametrically opposite each other on edge 28 of cover portion 22. On edge 28 of cover portion 22, flexible studs 60 are provided diametrically opposite each other in the region of the snap-in recesses 58. By applying a force onto the studs 60 radially from the outside in the direction of arrow 62, the studs 60 and the snap-in recesses 58 are moved inwards away from the locking projections 56. In this manner, the locking projections 56 which previously had been sunk into the snap-in recesses 58, can be moved out of their engagement with the snap-in recesses 58, whereby cover portion 22 can be withdrawn or moved out of receiving headpiece 36 or vice versa. This selective locking between receiving headpiece 36 and cover portion 22 advantageously facilitates the removal of film tube bag 12 from pressure chamber 34. Notably, as shown in FIG. 6, the film tube bag 12 which possibly has been compressed to the largest possible extent dictated by its design, can removed from out of pressure chamber 34 by removing the receiving headpiece 36 from the latter. During this phase, the receiving headpiece 36 serves as a "handling tab" for the film tube bag 12 which due to its folded or corrugated condition may rub against the inner wall of pressure chamber 34 and thus is removed from chamber 34 only by application of an increased force. After the film tube bag 12 has been removed in this manner from pressure chamber 34 as shown in FIG. 6, the studs 60 can be manually actuated to move inwards in the direction of arrow 62 of FIG. 7 and to thus release the locking arrangement 64 and thereby to separate cover portion 22 and receiving headpiece 36 from each other.

Figure 5:
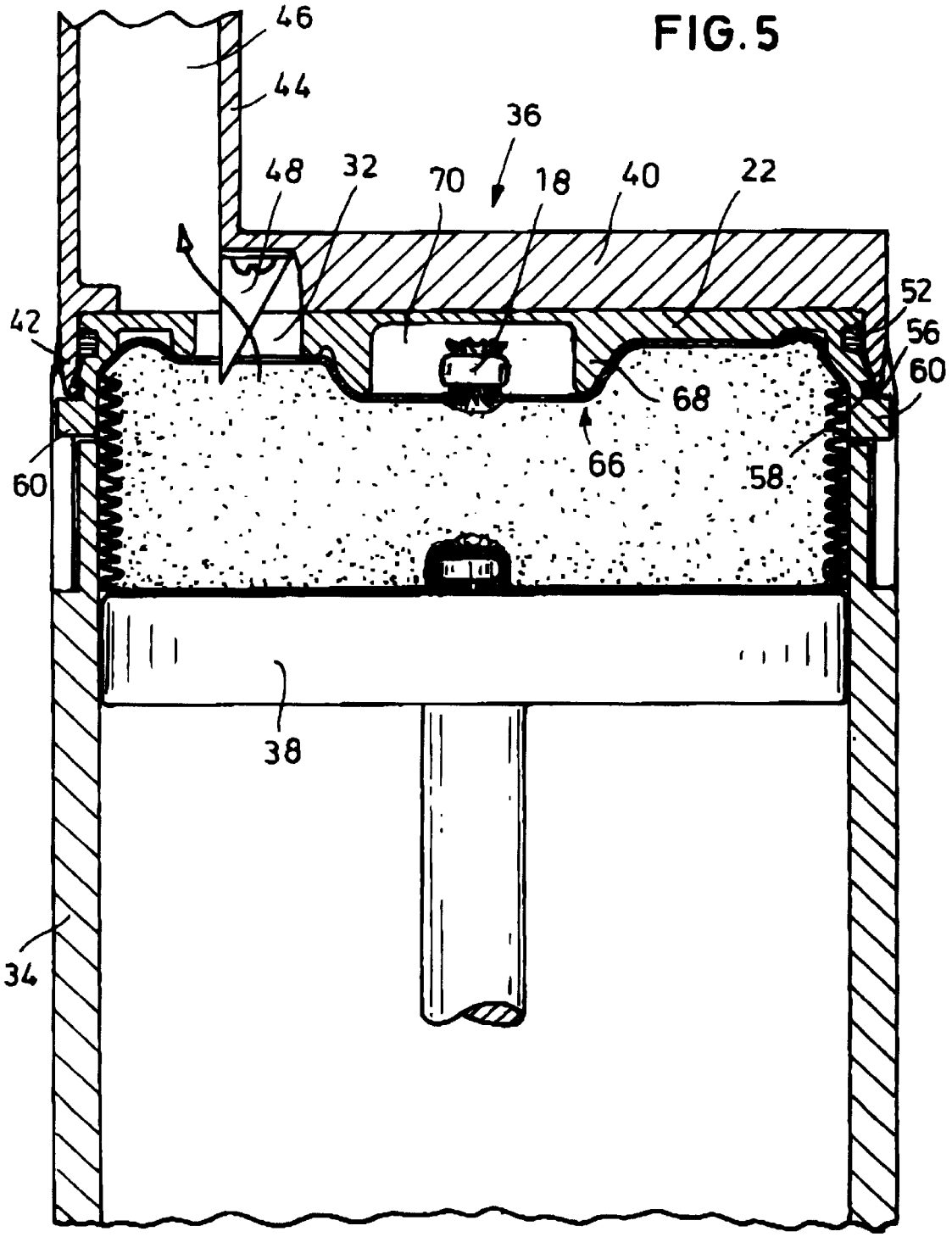
FIG. 5 shows a longitudinal section similar to that of FIG. 1 showing the completely compressed condition of the film tube bag.

As can be seen particularly from FIGS. 1 and 5, cover portion 22 comprises a central protrusion 66. This protrusion 66 is formed as a continuous collar 68 arranged on the inner end face of cover portion 22 facing towards the front end 16 of film tube bag 12. Said collar 68 defines a centrally arranged receiving space 70 serving to accommodate the closing clip 18 of film tube bag 12. Due to the central protrusion 66, the film tube bag 12, when subjected to pressure by pressure plate 38, will be pressed inwards also on the front end 16. In this manner, the residual volume of pasty substance 20 which still remains in the film tube bag 12 for design reasons, is advantageously reduced. The inward pressure exerted on film tube bag 12 on the front end 16 thereof offers the further advantage that the film tube bag 12 will bulge towards the edge of the front end 16 and thus, when used for the first time, will more reliably and tightly abut the edge of passage opening 32 and will be perforated more reliably by the piercing pin 48.

Figure 9:
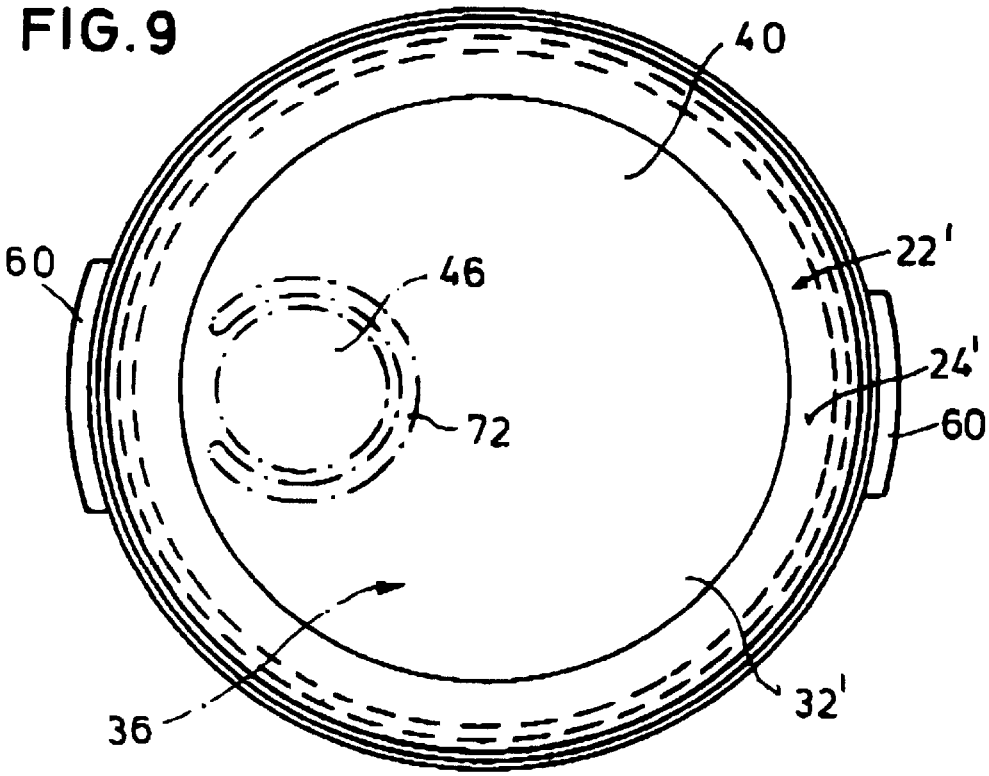
Figure 10:
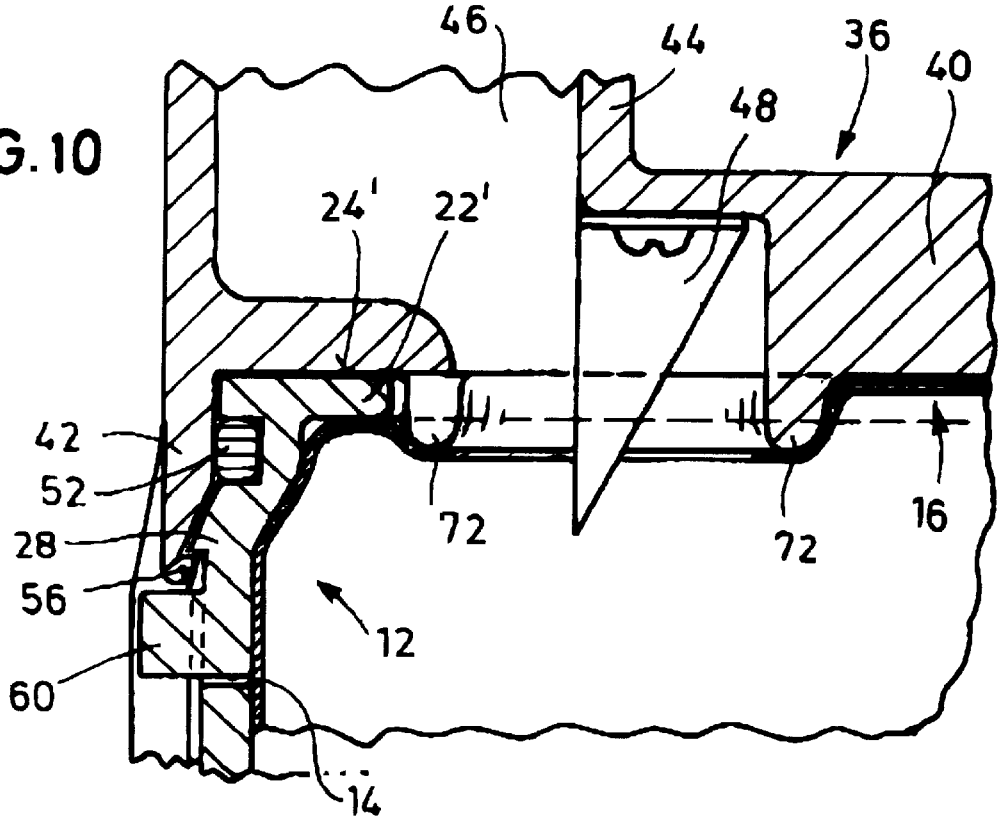

A further characteristic feature of the film packing 10 of the invention will be explained hereunder with reference to FIGS. 9 and 10. The cover portion 22' of this film packing is arranged as a shoulder ring whose end face is an annular face 24' having the edge 28 extending therefrom. Because of its annular structure, cover portion 22' defines a passage opening 32' in which the major part of the end 16 of the film packing is left exposed. The opening—arranged on the inner side of receiving headpiece 36—of the channel 46 formed by outlet piece 44, is partially surrounded by a sealing lip 72 which is particularly formed integrally with the receiving headpiece 36. Sealing lip 72 has the front end 16 of film tube bag 12 abutting thereon when the film tube bag 12 is subjected to pressure by pressure plate 38. Thus, this sealing lip 72 will seal the film tube bag 12 on the front end 16 thereof against the receiving headpiece 36. In this manner, even if the cover portion should not be formed as a full-faced disk, as is the case with the embodiment according to FIGS. 1 to 8, it is guaranteed that no pasty mass 20 will smudge the inner side of the receiving headpiece 36.

Figure 11:
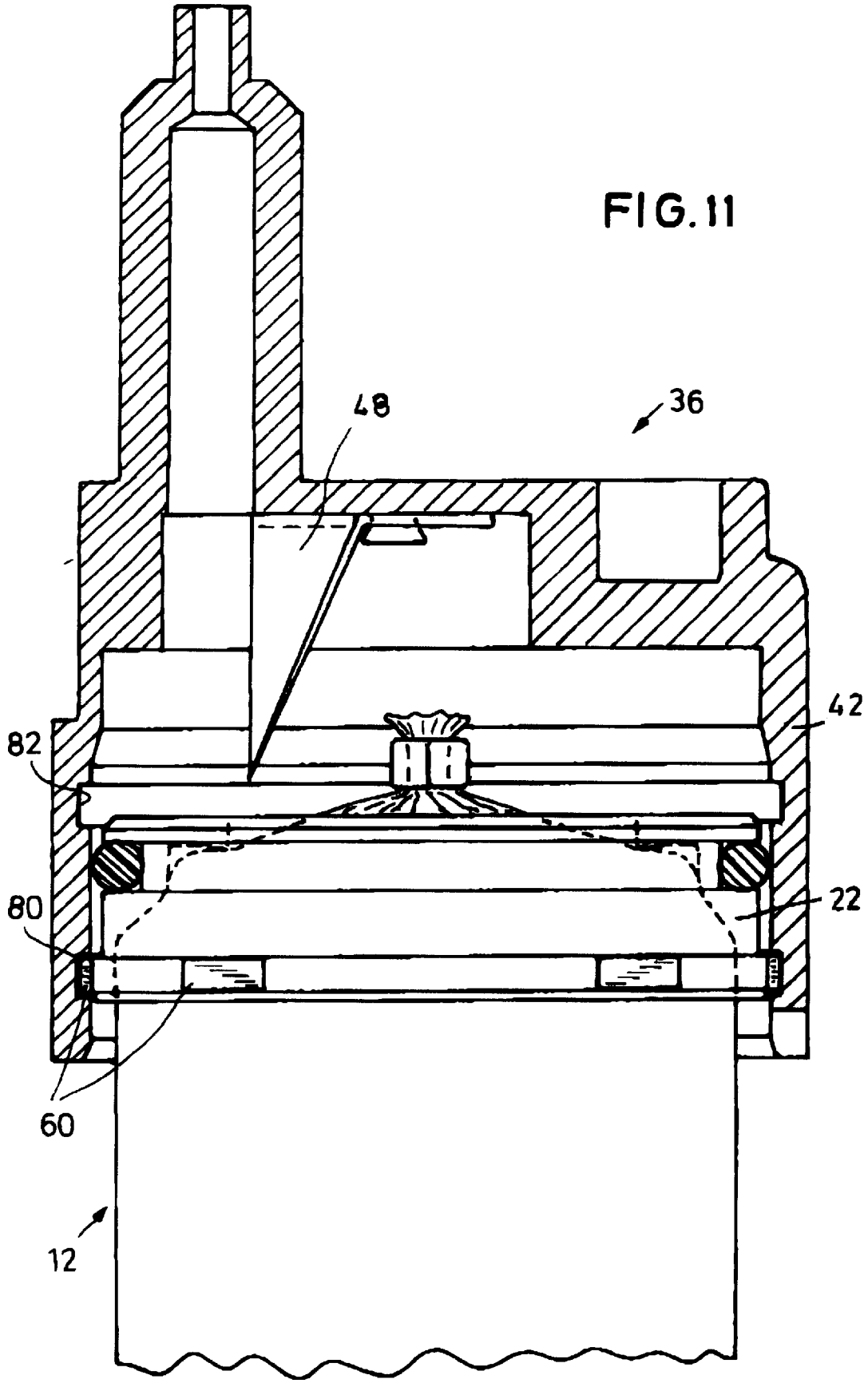
FIGS. 11 and 12 show another exemplary embodiment where the film tube bag, in a preliminary position, is snapped in the receiving headpiece such that it is shifted from said preliminary position into a final position in which the piercing pin has opened the film hose bag.
Figure 12:
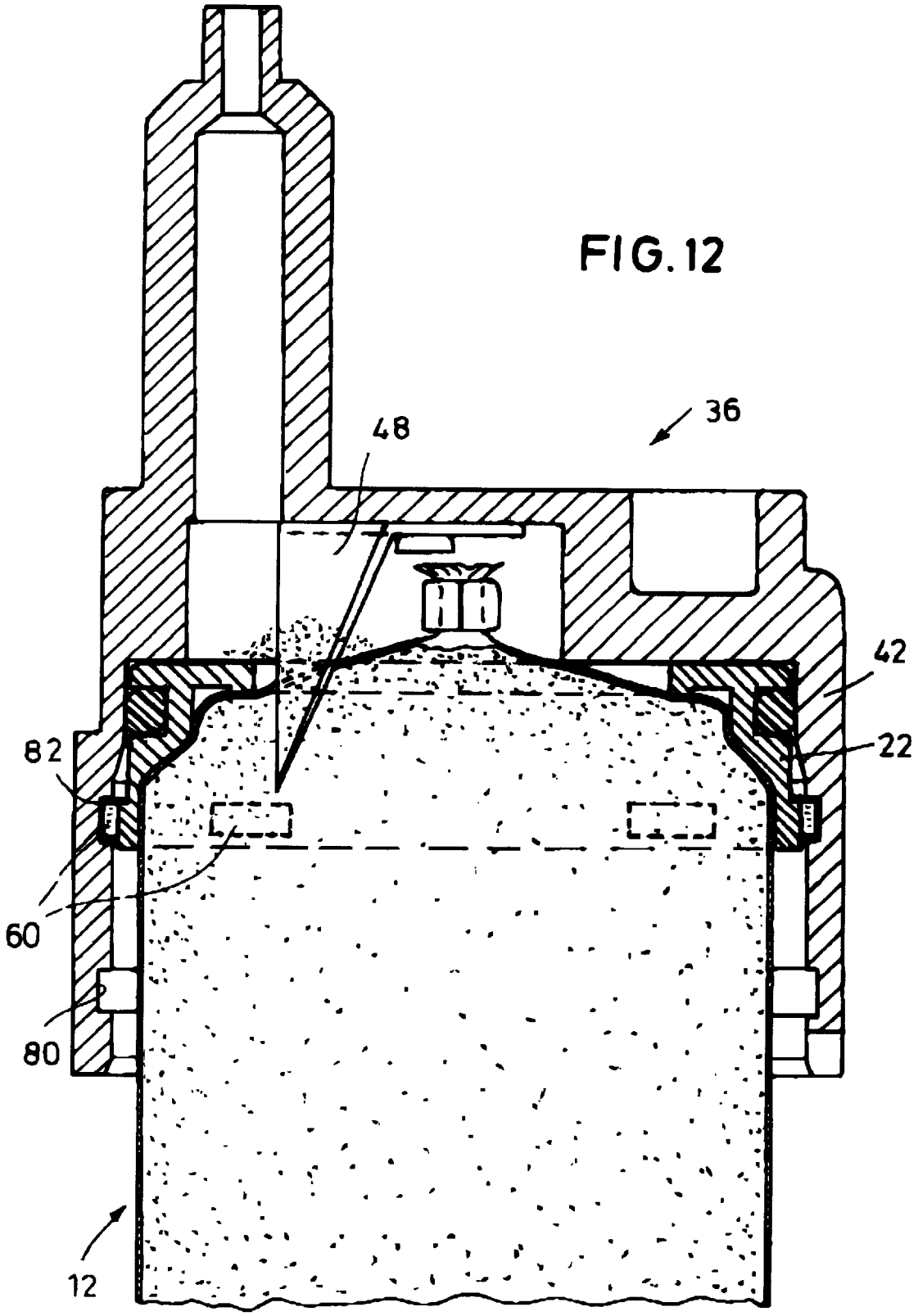

FIGS. 11 and 12 show a further embodiment of the film packing. The difference over the above described film packings resides in that the cover portion 22 can be locked on the receiving headpiece 36 in two positions arranged at different heights within receiving headpiece 36. The cover portion 22 comprises radially projecting snap-in projections 60 adapted to snap into one of two continuous inner grooves 80,82. These inner grooves 80,82 are formed in the cylindrical circumferential edge 42 of receiving headpiece 36 and have different distances from the inner end side of receiving headpiece 36. In the position according to FIG. 11, the snap-in projections 60 are locked in that inner groove 80 which is arranged at a farther distance from the piercing pin 48; in this condition, the film tube bag 12 is spaced from the piercing pin 48. The situation illustrated in FIG. 11 represents e.g. the transport condition of film packing 10. For opening the film tube bag 12, the user merely has to shift the bag farther into the receiving headpiece 36 (see FIG. 12) until the cover portion 22 abuts on the inside of the end face of receiving headpiece 36 and the snap-in projections 60 have immersed into the inner circumferential groove 82. In this condition, the piercing pin 48 projects into the film tube bag 12 so that the latter is opened.

Figure 13:
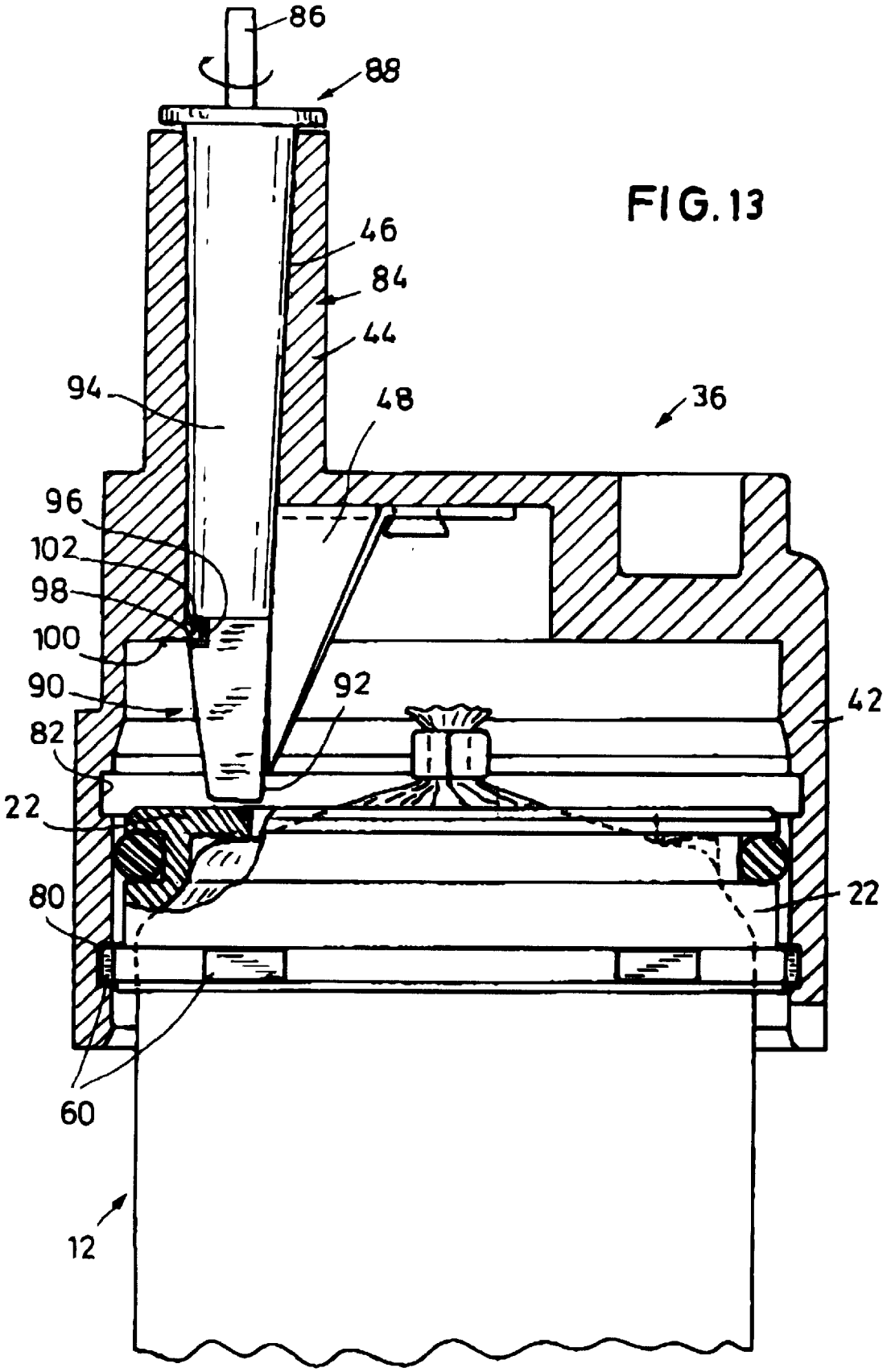
FIGS. 13 and 14 show, supplementary to the exemplary embodiment of FIGS. 11 and 12, a representation in which the film tube bag is protected against unintentional movement from its preliminary position towards its final position by an additional stopping element, said stopping element being shown in FIG. 13 in a twisting position within the outlet piece in which it is protected against axial movements, and in FIG. 14 in a twisting position in which the stopping element is adapted to be pulled out of the outlet piece.
Figure 14:
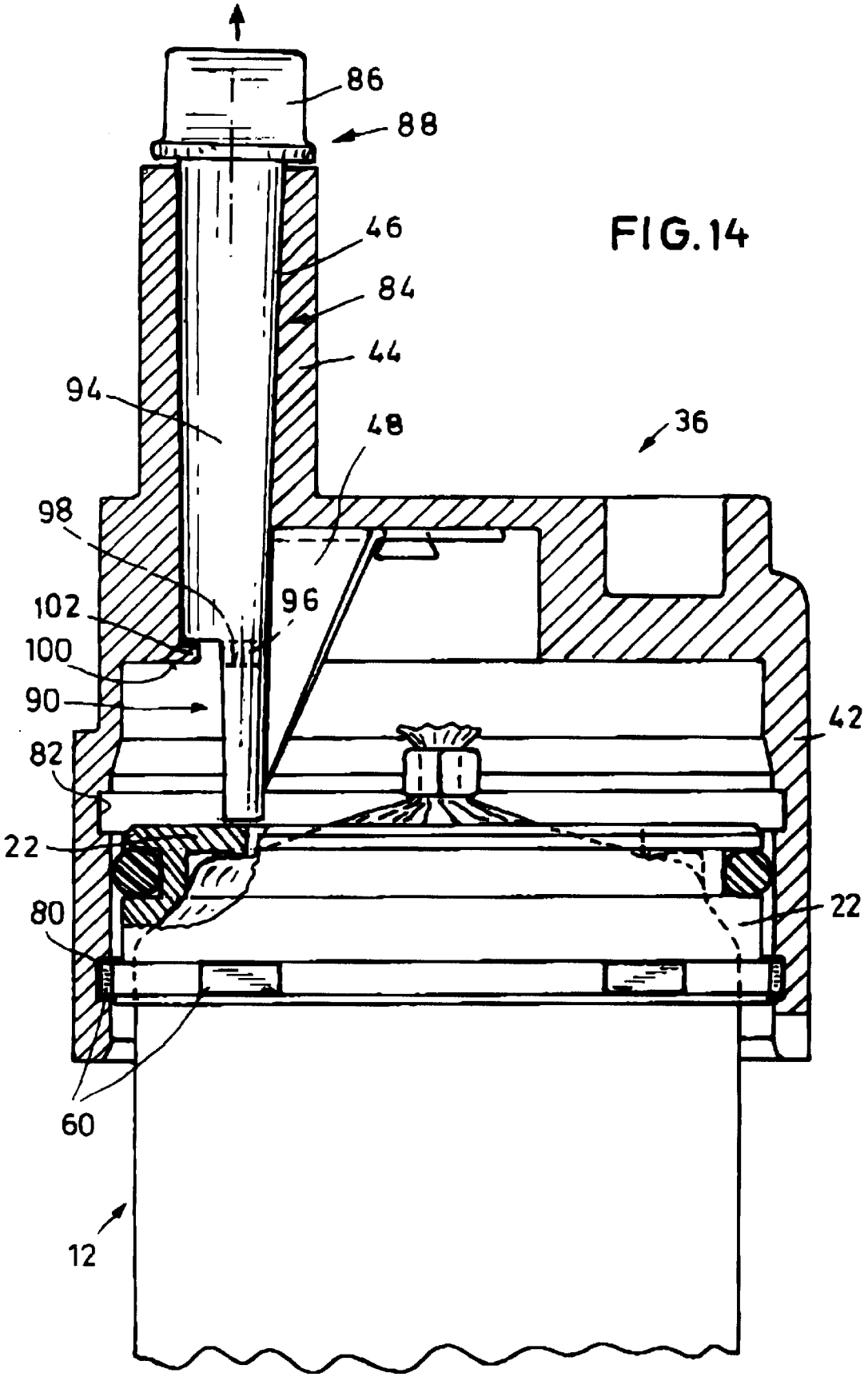

FIGS. 13 and 14 show a further alternative/addition to the film tube packing according to FIGS. 11 and 12. As in the embodiment according to FIGS. 11 and 12, the film tube packing according to FIGS. 13 and 14 comprises a film tube bag 12 which is prepositionable on the receiving headpiece 36; FIGS. 13 and 14 respectively show the situation wherein the cover portion 22 which is connected to the film tube bag 12, is arranged in the preliminary position (first position) on the receiving headpiece 36. In this preliminary position, the front end of film tube bag 12 does not yet contact the piercing pin 48 but is arranged at distance therefrom.

To reliably maintain the above preliminary position during transport of the film hose packing, the embodiment according to FIGS. 13 and 14 is provided with a pin- or bolt-shaped stopping element 84 which is inserted into the outlet piece 44. This stopping element 84, hereunder referred to as a stopping pin, can be twisted within outlet piece 44 between the first twisting position according to FIG. 13 and the second twisting position according to FIG. 14. For this purpose, stopping pin 84 is provided with a handle element 86 on its end 88 extending from the end of outlet piece 44 facing away from film tube bag 12. In the condition of complete insertion into outlet piece 44, the stopping end 90 of stopping pin 84, arranged opposite the handle element 86, extends beyond the end of piercing pin 48 (see the distance marked by 92). This stopping end 90 is arranged directly opposite the cover portion 22, so that, if the film tube bag 12 during transport is accidentally moved from the preliminary position towards the end position, the cover portion 22 is brought into abutment on the stopping end 90 of stopping pin 84. In this manner, the movement of film tube bag 12 in the direction of film tube bag 12 is limited.

To make it impossible that the stopping pin 84, while arranged in its stopping position according to FIG. 13, is undesirably moved axially out of outlet piece 44, the stopping pin 84 is locked on receiving headpiece 36 in this stopping position. For this purpose, the shaft 94 of stopping pin 84 is formed with a locking groove 96 opened radially outwards and having a locking face 98, with the latter formed that flank of locking groove 96 which is arranged closer to cover portion 22. This locking face 98 cooperates with a locking face 100 of receiving headpiece 36 which is formed by a projecting 102 radially projecting into the extension of the outlet channel 46 formed by outlet piece 44.

In the region where the locking groove 96 is formed, one half of the shaft 94 of stopping pin 84 is cut off as can bee seen in FIG. 14. The remaining part of stopping end 90 is provided with the locking groove 96. Thus, by rotating the stopping pin 84, locking groove 96 can be moved away from projection 102, so that the locking face 98 of stopping pin 84 will then not abut the locking face 100 of receiving headpiece 36 anymore. Consequently, in the twisting position according to FIG. 14, the locking pin 84 can now be moved axially out of outlet piece 44 so that the film tube bag 12 can then be moved in the direction of the piercing pin 48 and thus into the end position.

A further embodiment comprising an alternative configuration of the above securing arrangement for transport will be described hereunder with reference to FIGS. 15 to 20. In these Figures, components of the film tube packing which correspond to those of the preceding Figures, will be identified by the same reference numerals.

Figure 15:
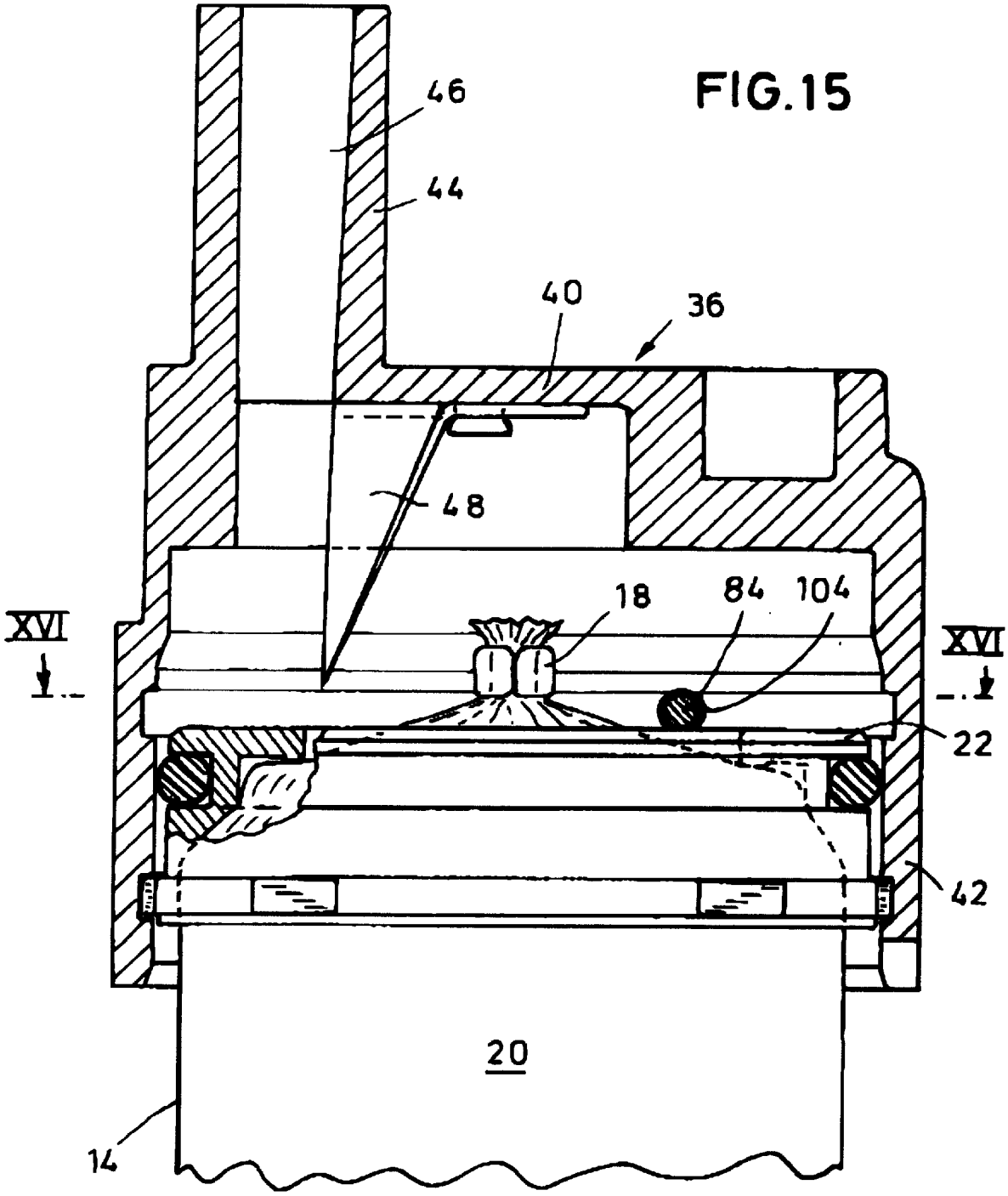

In the alternative film tube packing according to FIGS. 15 to 20, the stopping element 84, when assuming its stopping position according to FIGS. 15 and 16, extends in parallel to the cover portion 22 and the end wall 40 of receiving headpiece 36 through the space which formed between cover portion 22 and end wall 40. The stopping element 84, which is again formed as a pin or bolt, extends as a secant through the receiving headpiece 36 with the cylindrical edge 42. For this purpose, the continuous edge 42 comprises two openings 104,106. That part of the stopping element 84 which joins the handle element 86 extends through the opening 106, and the other end 108 of stopping element 84 extends through the other opening 104.

The locking of stopping element 84 on receiving headpiece 36 is performed by means of a locking projection 110 radially projecting from stopping element 84. Depending on the respective twisting position of stopping element 84, locking projection 110 is immersed into a corresponding locking recess 120 within opening 106 (see FIGS. 17, 18 and 20 showing the locking position of stopping element 84). In the unlocked position (see FIGS. 16 and 19), the locking projection 110 has been moved out of locking recess 120 so that the stopping element 84 can be pulled out of the two openings 104,106 in axial direction. Thus, in the locked position, the locking projection 110 is in engagement behind a counterpart projection 122 delimiting the locking recess 120 towards the outer side of edge 42 of receiving headpiece 36.

What is claimed is:

1. A film packing for a pasty substance, comprising a film tube bag (12) having a peripheral wall (14) and two ends (16), and a cover portion (22) fastened to one of the two ends (16) of the film tube bag (12), the cover portion (22) comprising an end face (24) having a passage opening (32) for the passage of pasty substance from the opened film tube bag (12), a peripheral face (26) joining the end face (24), and a sealing element (52) abutting a receiving headpiece (36) attachable to the end (16) of the film tube bag (12) carrying the cover portion (22), the receiving headpiece (36) surrounding at least the end face (24) and the peripheral face (26) of the cover portion (22) and comprising an outlet piece (44) which is in fluid connection with the passage opening (32) of the cover portion (22) when the receiving headpiece is attached (36), wherein a locking device (64) is provided for locking the cover portion (22) in a first position in the receiving headpiece (36) for securing against unintended movement of the film tube bag (12) farther into the receiving headpiece, and the receiving headpiece (36) comprises a piercing pin (48) extending from the end wall (40) of the receiving headpiece (36) towards the cover portion (22), the piercing pin (48) being located at a distance from the film tube bag (12) in the first position of the cover portion (22) and penetrating the film tube bag (12) in a second position of the cover portion (22).

2. The film packing according to claim 1, wherein the cover portion (22) and the receiving headpiece (36) are provided with mutually engageable elements of the locking device (64) for connecting the receiving headpiece (36) to the cover portion (22) to prevent unintended detachment and unintended movement from the first position towards the second position.

3. The film packing according to claim 1, wherein the sealing element (52) is arranged on the peripheral face (26) and/or in the transition region (30) from the end face (24) to the peripheral face (26) of the cover portion (22).

4. The film packing according to claim 1, wherein the locking device is configured as a mechanical connection between the cover portion (22) and the receiving headpiece (36) in the first position, said connection being provided with a weakening line for intended detachment of said connection.

5. The film packing according to claim 4, wherein the cover portion (22) and/or the receiving headpiece (36) are provided with a detachment element for manual release and breaking, respectively, of said connection.

6. The film packing according to claim 1, wherein a stopping element (84) is arranged on the receiving headpiece (36) and/or the cover portion (22), the stopping element (84) being movable between a stopping position, to prevent an unintentional movement of the cover portion (22) from the first into the second position, and a release position for moving the cover portion (22) from the first into the second position.

7. The film packing according to claim 6, wherein the stopping element (84) is a movement delimiter for limiting the movement of the cover portion (22) from the first position towards the second position.

8. The film packing according to claim 6, wherein the stopping element (84) in its stopping position extends into the space between the cover portion (22) and the receiving headpiece (36).

9. The film packing according to claim 6, wherein the stopping element (84) comprises a handling end (86) adapted to be manually gripped and in the stopping position projecting from the receiving headpiece (36), provided for manual movement of the stopping element (84) from the stopping position into the release position.

10. The film packing according to claim 6, wherein the stopping element (84) in its stopping position can be locked and/or blocked on the receiving headpiece (36) and/or on the cover portion (22) against unintended movement towards its release position.

11. The film packing according to claim 6, wherein the stopping element (84) is a stopping pin or stopping bolt.

12. The film packing according to claim 6, wherein the stopping element (84) in its stopping position extends through an edge (42) of the receiving headpiece (36) laterally gripping around the cover portion (22), into the space between the cover portion (22) and the end wall (40) of the receiving headpiece (36).

13. The film packing according to claim 12, wherein the stopping element (84) in its stopping position extends through two openings (104,106) in the edge (42) of the receiving headpiece (36).

14. The film packing according to claim 6, wherein the stopping element (84) can be positioned in the outlet piece (44) of the receiving headpiece (36) for rotation between a first twisting position wherein the stopping element (84) is secured against axial movement out of the outlet piece (44), and a second twisting position wherein the stopping element (84) can be pulled out of the outlet piece (44).

15. The film packing according to claim 14, wherein, when the stopping element (84) is arranged in the first twisting position, the movement delimiting end (90) of the stopping element (84) extends across the outlet piece (44) towards the cover portion (22), farther than the piercing pin (48).

16. The film packing according to claim 15, wherein a handle end (86) projects beyond the end of the outlet piece (44) facing away from the cover portion (22).

17. The film packing according to claim 6, wherein the stopping element (84) in its stopping position and its first twisting position, respectively, is held in positive locking engagement on the receiving headpiece (36) and the outlet piece (44) thereof, respectively.

18. The film packing according to claim 17, wherein the stopping element (84) comprises a locking face (98) facing towards a handle end (86), which locking face (98) upon rotation into the first twisting position can be brought into abutment with a corresponding locking face (100) of the receiving headpiece (36) facing towards the cover portion (22), and upon rotation into the release position can be brought out of engagement with the locking face (100) of the receiving headpiece (36).

19. The film packing according to claim 18, wherein the receiving headpiece (36) comprises a disk-shaped end wall (40) and edge (42) projecting therefrom, which edge (42) has two openings arranged along a secant.

* * * * *